United States Patent [19]

Davies et al.

[11] 4,410,041

[45] Oct. 18, 1983

[54] PROCESS FOR GAS-LIFTING LIQUID FROM A WELL BY INJECTING LIQUID INTO THE WELL

[75] Inventors: David R. Davies, Rijswijk, Netherlands; Edwin A. Richardson, Houston, Tex.

[73] Assignee: Shell Oil Company, Houston, Tex.

[21] Appl. No.: 200,176

[22] Filed: Oct. 24, 1980

Related U.S. Application Data

[63] Continuation-in-part of Ser. No. 127,355, Mar. 5, 1980, abandoned.

[51] Int. Cl.[3] ..... E21B 21/00; E21B 43/22; E21B 47/06

[52] U.S. Cl. ..... 166/250; 166/300; 166/312; 166/372

[58] Field of Search ..... 166/250, 255, 300, 305 R, 166/309, 312, 372; 73/151 R; 252/8.55 B; 417/108

[56] References Cited

U.S. PATENT DOCUMENTS

| | | | |
|---|---|---|---|
| 1,888,315 | 11/1932 | Gault | 417/108 X |
| 1,901,141 | 3/1933 | Battelle | 417/108 X |
| 2,061,865 | 11/1936 | Wells | 166/372 X |
| 2,293,196 | 8/1942 | Crump | 166/372 X |
| 2,632,513 | 3/1953 | Bennett | 417/108 X |
| 3,421,449 | 1/1969 | Cochran | 417/108 |
| 3,746,088 | 7/1973 | Haskin et al. | 166/59 |
| 3,750,753 | 8/1973 | Bernard | 166/309 |
| 4,178,993 | 12/1979 | Richardson et al. | 166/300 |
| 4,219,083 | 8/1980 | Richardson et al. | 166/312 X |
| 4,265,312 | 5/1981 | Thein | 166/312 |

*Primary Examiner*—Stephen J. Novosad
*Assistant Examiner*—George A. Suchfield

[57] ABSTRACT

A reservoir encountered by a drilling fluid-containing borehole can be sampled and/or a liquid can be removed from within a borehole by arranging conduits and a packer for isolating the reservoir or a selected fluid-removal location and then gas-lifting liquid by injecting an aqueous liquid solution which generates nitrogen gas within the borehole, with the depth of the injection and the rates of fluid inflow and outflow being adjusted to maintain a selected drawdown at the depth of the fluid-removal location.

12 Claims, 2 Drawing Figures

PROCESS FOR GAS-LIFTING LIQUID FROM A WELL BY INJECTING LIQUID INTO THE WELL

CROSS-REFERENCE TO RELATED APPLICATIONS

This is a continuation-in-part of application Ser. No. 127,355 filed Mar. 5, 1980 now abandoned.

BACKGROUND OF THE INVENTION

This invention relates to a drill stem testing process (or formation testing process) for determining what fluid, if any, can be produced from a subterranean reservoir which is encountered by a well being drilled. It also relates to a liquid-injection-effected process for gas-lifting liquid from within a well. It is especially useful for relatively remote and/or deep exploratory wells. The present process provides a comparatively quick and inexpensive, but safe, procedure for determining whether any fluid can be produced in response to a selected drawdown within a well; and it can provide a production test which is long enough and strong enough to indicate whether a suitable rate of production is apt to be sustained and/or whether the reservoir is apt to slough or produce sand.

Drill stem testing techniques and equipment have been known and used for more than about 50 years. Numerous improvements in the tools and techniques have been described in patents and publications such as the text book "Petroleum Production Engineering and Oil Field Development" by Uren (1941), U.S. Pat. No. 2,850,097; 3,038,539; 3,059,695; 3,233,676; 3,235,017 and technical journal articles, such as "Simple Field Checks Will Provide Accurate DST Data", World Oil, April 1974, and "Obtain Accurate Data From Deep Formation Tests", World Oil, October 1974, and the like.

In the early reservoir tests it was necessary to remove the drill string and replace it with a testing tool each time a test was to be made. More recently, combined drilling and testing tools were developed to avoid the need for pulling the drill string. But, even with the improved tools, it is necessary to remove enough drilling fluid from the borehole to reduce the hydrostatic pressure to less than the reservoir fluid pressure and provide a drawdown which will induce a fluid inflow from a productive formation. For example, in regions where adequate testing equipment and services are available and it is not essential to use a pressurized gas cushion within the testing tool, reservoir testing tools can be arranged to be run in dry (i.e., so that they are filled with air at atmospheric pressure) and operated so that, after a packer is set, the testing tool valves are opened to expose the formation to the drawdown imposed by a pressure which is initially substantially as low as atmospheric pressure.

Alternatively, where pressurized nitrogen is available, it can be pumped through such a testing tool string to displace the drilling fluid into the annulus. Then, after the packer is set, the gas can be depressurized at a controlled rate in order to initiate the production of fluid from the reservoir. Such a "cushion", comprising a pressurized gas within the test string at a pressure below the expected reservoir pressure, is often believed to be desirable. The cushion may avoid the risk of a dry run, e.g., due to the weight of liquid contained within the test string being excessive; or may avoid a tool-damaging surge of fluid inflow that may be accompanied by cavitation and a blowout, e.g., due to the amount of liquid within the test string being insufficient.

U.S. Pat. No. 3,612,183 describes a process for displacing the drilling fluid from the interior of a combined drilling and testing tool without using a cryogenic fluid such as liquefied nitrogen. The patented process injects a liquefied petroleum gas (e.g. propane) which is liquid at the pressure at which it is injected but becomes a suitably pressurized gas when the pressure is reduced.

During the course of research directed to problems such as the initiating of a flow of fluid from a reservoir in which the fluid pressure is less than the hydrostatic pressure of the liquid in a borehole which encounters the reservoir, initiating a perforation-cleaning pulse of relatively highly pressurized fluid and heat within a low pressure reservoir surrounding a borehole which has been cased and perforated, etc. it was discovered that various organic and/or inorganic reactants could be dissolved in an aqueous liquid to form a gas-generating solution which is capable of generating a significantly large volume of gas at a suitable rate within a borehole or a reservoir. Such gas-generating aqueous liquid solutions are described, in U.S. Pat. No. 4,178,993 by E. A. Richardson and R. F. Scheuerman, for initiating a flow into a well by reducing the hydrostatic pressure within a liquid-containing wellbore. The U.S. Pat. No. 4,178,993 describes injecting a solution of nitrogen gas-forming reactant having a composition and concentration correlated with the pressure, temperature and volume properties of the well and reservoir so that the solution remains substantially unreactive until it reaches a selected depth within the borehole and then begins to generate gaseous nitrogen at a moderately rapid rate.

U.S. Pat. No. 4,219,083 by E. A. Richardson, R. F. Scheuerman and D. C. Berkshire relates to chemically inducing a backsurge of fluid through well casing perforations. It describes injecting a solution of nitrogen gas-forming reactants through the well casing perforations and into the reservoir. The solution used in U.S. Pat. No. 4,219,083 patent comprises the solution of U.S. Pat. No. 4,178,993 patent modified by an addition of a reaction-retarding alkaline buffer and a pH-reducing reactant capable of subsequently overriding that buffer. It was found that such reactants could be arranged so that the solution remains substantially unreactive within the well but, within the reservoir, becomes an acidic, fast-reacting solution which generates a rapid-rising pulse of heat and gas having a pressure sufficient to cause a debris-removing backsurging of fluid through the casing perforations.

We have now discovered that particular ones of such gas-generating reactants can be used in particular ways in conjunction with particular types of drilling and testing tools in a manner which provides an unobviously advantageous process for testing a subterranean reservoir and/or removing liquid from within the borehole of a well.

SUMMARY OF THE INVENTION

The present invention relates to a well treating process for gas-lifting liquid from a selected fluid-removal depth within a borehole which contains a liquid. In a preferred procedure, a first pipe string which is equipped with a remotely-actuable packer or annulus sealing means is positioned within the borehole so that the pipe extends from a surface location to a selected fluid-removal depth within the liquid contained in the borehole. The sealing means is actuated to seal the annulus around the pipestring in a location above the fluid-removal depth. A second pipestring is extended within the first pipestring to a depth sufficient to provide a selected reduction in the fluid pressure within the borehole at the fluid-removal depth when a gas replaces a significant proportion of the liquid within the first and second pipestrings in locations above the bottom of the second pipestring. A gas-generating aqueous liquid solution is compounded so that it is a solution which (a) contains ammonium ions and nitrite ions (b) is self-reacting at the temperature within the borehole and (c) reacts to form gaseous nitrogen and a relatively inert oil-immiscible aqueous solution. The gas-generating solution is flowed into the top of the second pipestring while fluid is flowed out of the top of the first pipestring and the flow rates are correlated so that gas replaces at least a significant proportion of the liquid within the first pipestring in a location above the bottom of the second pipestring. Those flow rates are then adjusted, to the extent required, to cause the fluid pressure within the borehole at the selected fluid-removal depth to be reduced to and maintained at a selected relatively low value while liquid is being gas-lifted to a surface location.

In general, where a borehole is equipped to avoid any undesirable inflow or outflow of fluid above said selected fluid-removal depth, said pipestrings can be free of packers and can comprise pairs of substantially any fluid conduits (such as a tubing string and the annular space between it and a surrounding pipe or casing string, a pair of substantially parallel pipestrings or the like). The conduits used should be arranged to convey fluid from the selected fluid-removal depth to a surface location. They should also provide separate fluid flow paths except for a fluid interconnection at a depth located (as described above) near enough to the selected fluid-removal depth to be capable of significantly lowering the hydrostatic pressure at that depth when a significant proportion of the liquid in the upper portion of at least one of the conduits is replaced by gas.

The present invention provides a uniquely advantageous process for testing a subterranean oil reservoir which is encountered by a borehole which contains a drilling fluid. In such a process each component of the gas-generating solution is selected so that both the solution components and its reaction products are substantially immiscible with oil. The depths to which the pipestrings are extended are preferably selected so that the gas-lifting of liquid can subject the reservoir to a pressure drawdown representative of one expected to provide a suitable rate of oil production. And, the gas-lifting of the reservoir oil is preferably continued for long enough to provide both a significant duration of testing and enough oil for a relatively definitive analysis of what can be produced from the reservoir during an oil production operation.

The present invention is also uniquely advantageous for conducting a well cleaning operation for removing substantially any gas-liftable liquid from a selected depth within a borehole. Such a "gas-liftable" liquid can comprise substantially any liquid solution or dispersion of liquid or solid materials which can feasibly be displaced upward within a liquid-filled conduit through which a gas is bubbled. Such a process can be used to remove suspensions of solids, such as sand or silt, etc.; liquids or semi-solids, such as resins, tars or gels or the like; or to remove a corrosive or undesirable well treatment liquid, such as an acidic liquid, or the like. It is particularly useful in wells in a location in which the conventional types of swabbing and/or sand washing equipment are unavailable or unfeasibly expensive.

DESCRIPTION OF THE INVENTION

Figure 1:
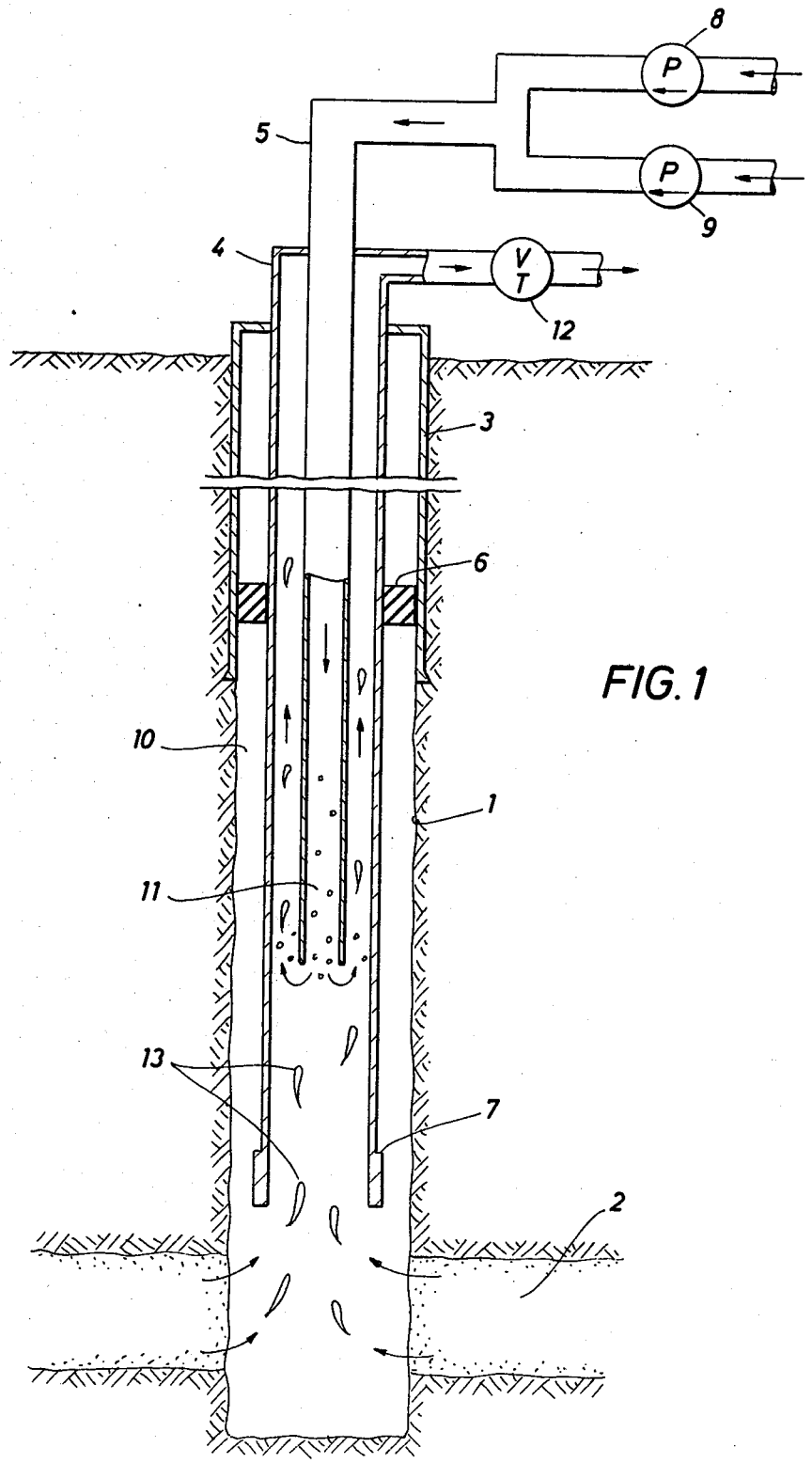
FIG. 1 is a schematic illustration of a well and reservoir in which the present process is being employed.

FIG. 1 shows a borehole 1 which has been extended into fluid communication with an oil-productive reservoir 2. An outer string of casing 3 is cemented within the upper portion of the borehole. First and second pipestrings 4 and 5 have been extended through the casing 3 and into the borehole. As known to those skilled in the art, such pipestrings should be inserted sequentially through suitable wellhead equipment, such as that which is currently available, (not shown) inclusive of blowout preventors, control valves pipestring hangers, etc.

The first pipestring 4 is provided with an annulus packer 6 which has been actuated to seal the annulus between the pipe 4 and the casing 3. As will be apparent to those skilled in the art, the first pipestring 4 and associated packer could comprise a combination drilling and testing tool, which would be equipped with a drill bit and/or a borehole wall-seating packer such as those which are currently available.

The pipestring 4 is preferably also equipped with a downhole pressure-recording gauge 7 for providing a retrievable log of the variation in borehole fluid pressure with time. As know, such gauges, when positioned at a known depth near those of a reservoir or a selected fluid-removal depth, can provide pressure data which, when combined with the rate and character of fluid production from the reservoir, may yield valuable information relative to the producing capabilities of the reservoir and/or the condition of the borehole.

Prior to the well completing stage shown, pumps 8 and 9 have been operated to inject fluids which were mixed, within pipestring 5, to form a gas-generating solution 11. The so-injected fluids could advantageously comprise, respectively, a solution consisting essentially of about 16% by weight ammonium chloride (about 3.0 M/l) in water and one consisting essentially of about 20% by weight of sodium nitrite (about 3.0 M/l) in water.

At the well completion stage shown, the borehole 1 contains a gas-liftable liquid 10, such as a drilling fluid having a density which provides a hydrostatic pressure at the depth of the reservoir that exceeds the fluid pressure within the reservoir. The gas-generating solution 11 is flowed into the borehole through the second-installed pipestring 5 while fluid is outflowed through the first-installed pipestring 4 as shown by arrows. The flow rates are controlled so that the inflowing solution begins to generate a mixture of gas and relatively low density aqueous liquid, at least by about the time it reaches the bottom end of the pipestring 5. The inflow of gas into the lower portion of pipestring 4 causes a gas-lifting of both the reaction-generated aqueous liquid and the drilling fluid. It will be apparent that if a significant amount of gas accumulates within pipestring 5, the pressure required to inject fluid into the pipestring 5 tends to rise. For example, if only gas remained within pipestring 5, the pressure required to inject fluid into that pipe string could rise to about the hydrostatic pressure of the fluid within the borehole at the depth of the lower end of the pipestring 5.

In a preferred method of operating the invention, the outflow of fluid through pipestring 4 is throttled by means of throttling valve 12, or the like, to the extent required to maintain the pressure of the outflowing fluid at near, but less than the pressure required to inject fluid into pipe string 5. In this way the gas-lifting of liquid out of pipe string 4 first replaces liquid that was initially present in the pipe strings 4 and 5 above the bottom of pipe string 5 with a relatively low density, mostly gaseous, mixture of gas and aqueous liquid (which is generated by the gas-generating solution 11) without significantly changing the pressure within the borehole below the bottom of pipe string 5.

At the stage shown in the drawing, valve 12 has been opened to an extent which reduces the pressure of the fluid flowing out of pipe string 4 to near atmospheric pressure. This causes the borehole fluid pressure at the reservoir depth to be reduced to near that of the hydrostatic head of the column of liquid (i.e., mainly drilling fluid 10) extending between the reservoir and the bottom of pipe string 5. When sufficient gas accumulates in tubing string 4, this induces an inflow of oil, represented by globules 13, into the borehole. Thus, by making the gas-lifting effect of the gas-generating solution adequately efficient, for example, by utilizing relatively high flow rates and/or an incorporation of a foam-forming surfactant in order to sweep out, and/or entrain and suspend within a foam, substantially all of the liquid which is being discharged from the bottom of pipe string 5, the borehole fluid pressure at a selected depth, such as the reservoir depth, can be reduced to substantially that of atmospheric pressure plus the hydrostatic head of fluid, e.g., reservoir fluid, gas, spent aqueous solutions, etc., which is located between the reservoir or other selected depth and the upper end of the pipe string 4.

Such a pressure-lowering effect is relatively independent of the depth at which packer 6 forms a seal across the annular space between pipe string 4 and the surrounding casing or borehole wall. That seal traps a column of the liquid (such as drilling fluid 10) contained within the borehole. But, since the liquid tends to flow downward away from the seal, it is generally preferable to locate the bottom of the first pipe string 4 near but above a producing reservoir which is to be tested. In this way most, if not all, of any relatively low density reservoir fluid tends to be included within the fluid flowing into the pipe string 4—rather than simply rising (by gravity segregation) into the annulus around the pipe string.

If a reservoir being tested should contain a heavy oil or tar which tends to settle or accumulate in the bottom of the well (rather than rising through a column of static liquid, such as a drilling fluid to a depth from which it is gas-lifted to a surface location) a subsequent fluid circulation step can be used to obtain a sample of the reservoir fluid. In such a situation, the present process can be operated as described above for a time sufficient to cause an inflow of a significant sample of the reservoir fluid. Then, by means of reverse circulation, preferably with the lower end of the tubing string 5 moved down to or below the depth of the reservoir, the accumulated sample can be displaced to the surface; for example, by injecting a high density fluid, such as a drilling fluid, into pipe string 4 while outflowing fluid through pipe string 5.

Figure 2:
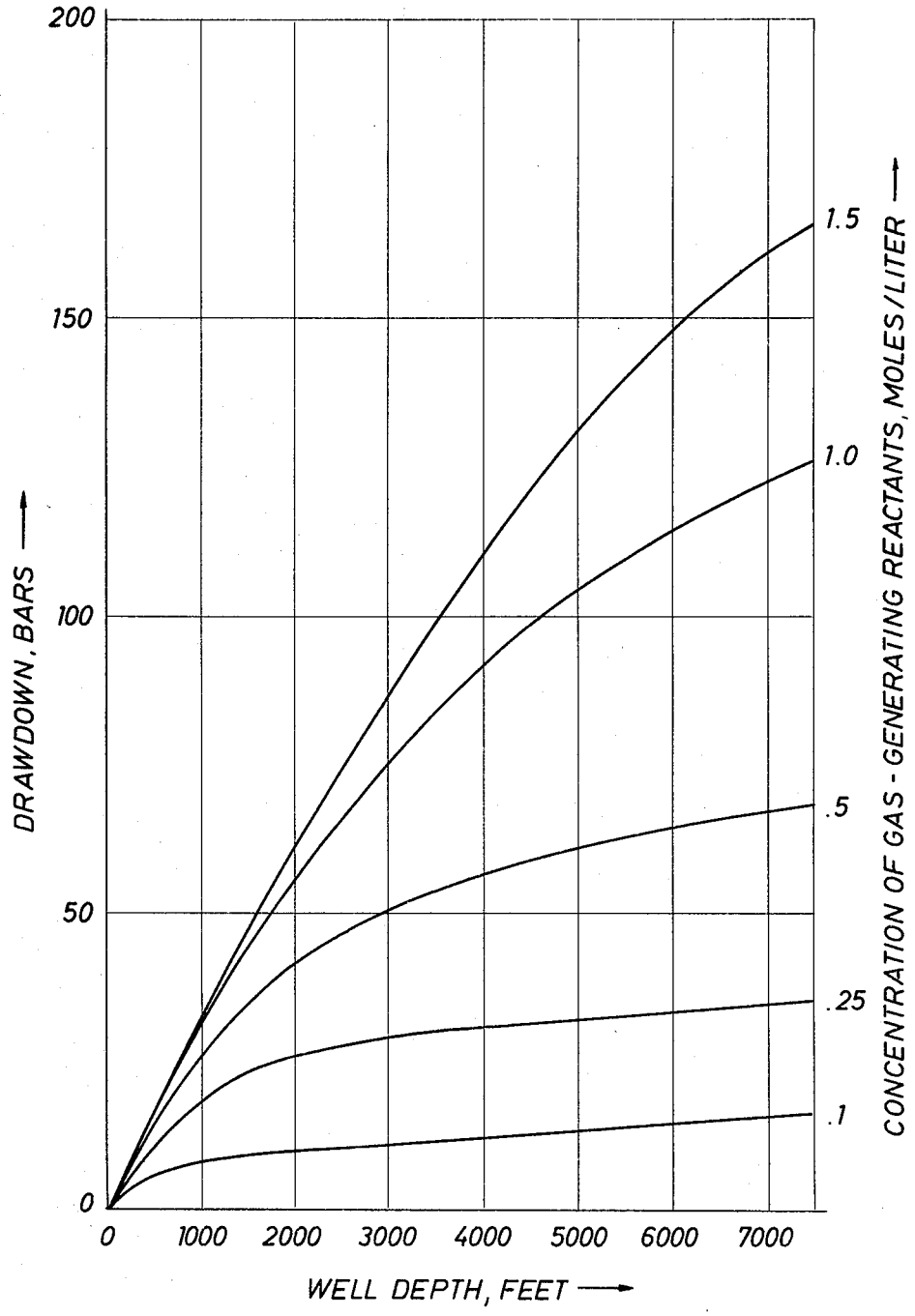
FIG. 2 is a graph of variations in the amount of the borehole fluid pressure reductions which can be provided by various gas-generating solutions at various fluid-removal depths within the borehole of a well.

FIG. 2 shows the variation in the amount of borehole fluid pressure reduction which can be provided by gas-generating solutions of various concentrations at various depths within the borehole of a well. The figure relates to gas-generating solutions which consist essentially of water, sodium nitrite and ammonium chloride and react in accordance with the equation $$NaNO_2 + NH_4Cl \rightarrow N_2 + 2H_2O + NaCl.$$

FIG. 2 relates to a well in which the reservoir fluid pressure corresponds to a hydrostatic pressure gradient of about 0.465 (8.9 lbs. per gallon). It shows the drawdowns, in bars (14.5 psig per bar), which can be attained at the depths listed along the bottom of the plot when substantially all of the liquid above each such depth is replaced by a foam of nitrogen gas dispersed in the aqueous liquid produced by the above reaction. FIG. 2 shows this for each of the gas-generating solutions that contain substantially equimolar proportions of sodium nitrite and ammonium chloride in the amounts which are listed along the right side of the plot. In each case the temperature of the fluids in the well are assumed to equal a reservoir temperature corresponding to a temperature gradient of about 1.2° F. per 100 ft.

Field Test Example

The well in which the test was conducted was completed in a manner generally similar to that shown in FIG. 1. However, in this well the casing was extended from the surface to substantially the depth of the reservoir. A free-hanging tubing string was hung above the reservoir with its lower end in fluid communication with the annulus between it and the casing. A wire-wrapped screen was suspended from an annulus sealing packer arrangement below the end of the tubing and was surrounded by a gravel pack in a near bottom section of the borehole, adjacent to an oil-containing reservoir. The tubing and annulus thus provided a pair of separate conduits having a suitably located point of fluid communication for use in the present process.

It was decided to pump the nitrogen-generating fluid down the tubing so that a pressure gauge, such as an Amerada gauge, could be positioned near the bottom to record the drawdown exerted on the formation. The cross-sectional volume of the annulus was considerably larger that that of the tubing. It was initially planned to use a solution that was one molar in each of sodium nitrite and ammonium chloride and 0.2 molar in sodium acetate and 0.05 molar in hydrochloric acid, which would provide a half-life of about 60 to 100 minutes at the well temperature of about 115° (bottom hole temperature of the well). With that solution an average pump rate of 0.4 to 0.25 barrels per minute could be used to inject about 110 barrels of fluid.

However, in view of a rather limited mixing tankage volume at the well site, it was decided to raise the molarity of the reactants from 1 to 1.5 molar and reduce the pumping rate to an average of about 0.24 barrels per minute—with the slower pumping rate being compensated by the faster reaction rate.

It was unexpectedly found that when the top of the annular conduit was opened, a relatively dry oil, which had floated above the brine, was freely produced at about 450 barrels per day. This made it desirable to use a fast-reacting gas-generating solution to ensure that the density gradient of that solution (by the time it reached the bottom of the tubing) would be less than that of the oil, in order to be sure that the gas-generating solution would rise above the annular column of oil and would thus induce a smooth start-up of the gas-lifting of the oil.

For in situ generation of nitrogen, 50 bbls of a solution composed of 41.6 bbls of water and 31.5 sacks of Na $NO_2$ (each sack containing 100 kg) were pumped at 0.1 B/M from one pump (such as pump 8 of (FIG. 1) and mixed at the same rate with a solution of 50 barrels (injected at the same rate by another pump) composed of 40.6 barrels of water, 24.5 sacks of $NH_4Cl$, 5 sacks sodium acetate, 74 liters of 37% HCl and 76 liters of HOWCO-SUDS foaming surfactant. During the pumping an annulus valve (equivalent to valve 12 of FIG. 1) remained open.

After about 1 hour, the well began to flow from conduit 4 through valve 12 at a rate of 600 bbls of oil per day. This rate was maintained until the test ended (when all the solutions had been pumped-about 8 hours). The drawdown estimated from calculations similar to those used to form the graph shown in FIG. 2 was 600 psi. Actual measurements during the production test were indicative of a 550 psi drawdown.

The test results indicated that the present process is capable of bringing a well into production for a significant period of time after, for example, a treatment such as gravel packing, which required the killing of the well. Or, the invention can be used for cleaning up the crude and obtaining a representative sample prior to a later pump rod installation and pump testing in a newly drilled well, in addition to providing a drill stem test of a heavy oil-bearing formation, or the like. In general, the efficiency of such a gas-lifting of a particularly viscous oil can be materially improved by injecting the gas-generating solution through a relatively slender tubing string and gas-lifting the oil within a relatively large annular conduit surrounding that tubing string and/or by supplementing the lifting process by a foaming and/or thickening of the gas-generating solution.

Suitable Components and Situations

The present invention is applicable to the testing or other treating of substantially any type of reservoir at substantially any depth. Its use is particularly beneficial in regions in which it is difficult or unfeasible to obtain reliable drill stem testing services or supplies of pressurized nitrogen or where it is desirable to conduct a relatively long production test in response to a commercially attractive extent of drawdown (for example, to evaluate sloughing, sand production, or the like characteristics of a reservoir).

The nitrogen-containing gas-forming reactants which are suitable for use in the present process comprise water-soluble inorganic ammonium ion-containing compounds which are relatively reactive at substantially ambient temperatures and are capable of reacting with an oxidizing agent within an aqueous medium to yield nitrogen gas and a substantially inert, relatively low-density, oil-immiscible aqueous saline solution. Examples of suitable ammonium ion-containing compounds include the ammonium salts of halogen acids, such as ammonium chloride; such salts of nitric, sulphuric, and nitrous acids and the like acids. Where available, ammonium nitrite can be utilized to provide both the ammonium ion and the nitrite ion, if the ambient temperatures are such that an undesirable extent of reaction does not occur while the compound is being dissolved in an aqueous liquid.

The oxidizing agents suitable for use in the present process comprise substantially any water soluble salts of nitrous acid which are compatible with and capable of reacting with the ammonium ion-containing compound within an aqueous medium to form nitrogen gas and a relatively low-density, oil-immiscible, aqueous saline solution. The alkali metal or ammonium nitrites are particularly suitable.

Aqueous liquids suitable for use in the present invention comprise substantially any in which the salt content does not, for example by common ion effect, prevent the dissolving of the desired portions of ammonium ion and nitrite ion-containing rectants. In general, substantially any relatively soft fresh water or brine can be utilized. Such aqueous liquids preferably have a dissolved salt content of less than about 2000 ppm monovalent salts and less than about 100 ppm multivalent salts.

Buffering compounds or systems which are suitable for use, if desired for moderating or accelerating the rate of gas generation, can comprise substantially any water-soluble buffer which is compatible with the gas-forming components and products and tends to maintain the pH of an aqueous solution of the selected ammonium ion and nitrite ion-containing compounds and a slightly acidic pH at which the reaction proceeds at a suitable rate at the ambient surface temperature. As illustrated in the drawing, where the reaction rate is significantly rapid at the surface temperature at the well site, the ammonium ion-containing and nitrite ion-containing compounds are preferably dissolved (for example, at substantially twice the selected molar concentration) in separate aqueous liquids which are pumped by separate pumps so that they are combined within a pipe or container maintained at the injection pressure at which the gas-generating liquid solution is injected into the well. In general, a suitable pH at which to buffer the gas generating solution is from about 4.0 to 7. Examples of suitable buffering materials include the alkali metal salts of weak acids such as carbonic, acetic, citric and the like.

As described in greater detail in the above mentioned U.S. Pat. No. 4,178,993, it is generally desirable to use substantially equimolar proportions of ammonium and nitrite ions, particularly when using concentrations in the order of from about 1 to 6 moles per liter of gas-generating reactants. The disclosure of U.S. Pat. No. 4,178,993 are incorporated herein by cross-reference.

In general, the concentration of the gas-generating reactants in the gas-generating solution can be varied relatively widely according to the amount of drawdown desired on the well. This is shown in FIG. 2. The concentrations can range from as low as about 0.1 moles per liter, at which the rate and extent of gas generation begins to diminish to a point at which the gas-lifting capability becomes insufficient to lift significantly more liquid than the aqueous saline liquid which is formed along with the formation of the gas. And, where relatively high rates and high volumes of gas generation are desirable, the concentration of the ammonium ion and nitrite ion-containing reactants can approach or even exceed their saturation concentrations within the aqueous liquid being injected into the well. Such a supersaturation can be tolerated up to an extent where dispersed undissolved particles begin to interfere with the flow properties of the slurry being injected. In general, the preferred ranges of concentration are from about 1 to 6 moles per liter of each of the components of the gas-generating reaction.

The corrosion rate of a fresh steel surface exposed to a freshly prepared $N_2$-generating solution is shown in Table I. The corrosion rates are small in all cases (less than 0.05 lbs iron/ft$^2$ of steel surface exposed—a typically acceptable maximum loss of steel tolerable in oil field applications). However, if less corrosion is desirable in a particular case, a corrosion inhibitor (such as Rodine 31A-test 4B) can be added to reduce the corrosion rate yet further.

TABLE 1

| No. | Composition of $N_2$—Generating Solution (M/L) | T °F. | $t_{\frac{1}{2}}$ (minute) (*1) | Time (hours) (*2) | Weight Loss (Lbs/Sq ft) |
|---|---|---|---|---|---|
| 1 | Methyl formate; 2.0<br>Urea; 1.0<br>Sodium nitrite; 2.0<br>pH; 6-7 | 187 | 130 | 16 | 0<br>(*3) |
| 2 | Chloroacetic Acid; 2.0<br>Urea; 1.0<br>pH; 5.7 | 200 | 18 | 3 | .00046 |
| 3 | Sodium acetate; 0.5<br>Ammonium chloride; 3.0<br>Sodium nitrite; 3.0<br>pH; 6.5 | 165 | 95 | 4 | .00035<br>(*4) |
| 3A | As No. 3, except:<br>pH; 6.8 | 165 | 95 | 19 | .0023 |
| 4 | Sodium acetate; 0.2<br>Ammonium chloride; 1.5<br>Sodium nitrite; 1.5<br>pH; 4.8 (1:3 buffer) | 115 | 135 | 13 | .016<br>(*5) |
| 4A | As No. 4, except:<br>pH; 4.3 (1:1 buffer) | 86 | 65 | 5 | .017<br>(*5) |
| 4B | As No. 4A, except:<br>5% wt. Rodine 31A Inhibitor was added | 115 | 65 | 14 | .0011 |

(*1) Time required to generate ½ stoichiometric amount of gas.
(*2) Measured from time solution is heated to indicated temperature until time test coupon is removed and weighed.
(*3) Three pinpoint-sized rust spots noted.
(*4) No corrosion accured until solution was essentially spent.
(*5) 75% of total weight loss occurred during first 1.5 hours of the test.

As disclosed in U.S. Pat. No. 4,178,993, where desirable foam-forming surfactants can be dissolved or dispersed in the gas-generating solution in order to enhance the liquid removing capability of the gas which is formed within the well. Suitable surfactants are those capable of being dissolved or dispersed in the ammonium and nitrite ion-containing aqueous solution and remaining substantially inert during the nitrogen gas producing reaction. Examples of suitable surfactants include foam-forming anionic, nonionic, or cationic surfactants, such as Howco Suds, Neodol Sulfate 25-3S, Triton 4-100.

As disclosed in U.S. Pat. No. 4,178,993, where desirable, water-thickening agents can also be incorporated in a foaming agent-containing gas-generating solution of the present invention to enhance the liquid-lifting power of the foam. Suitable thickening agents are those which are water-soluble and compatible with the gas generating liquid solution and the mixture of gas, drilling mud, and/or petroleum products which are formed as the fluids are mingled within the wellbore. Examples of suitable thickening agents include xanthan gum polymers, hydroxyethyl celluloses, carboxymethyl celluloses, and the like thickeners.

What is claimed is:

1. A well treating process for gas-lifting liquid from a borehole which contains a liquid, comprising:

extending a first pipe string which is equipped with a remotely-actuatable annulus sealing means within the borehole from a surface location to a selected fluid-removal depth within the liquid in the borehole;

actuating the sealing means to seal the annulus around the first pipe string in a location above said fluid-removal depth;

extending a second pipe string within the first to a depth sufficient to reduce the fluid pressure at said fluid-removal depth when a significant proportion of liquid within the first and second pipe strings in locations above the bottom of the second pipe string is replaced by gas;

compounding a gas-generating aqueous liquid solution of inorganic compounds which solution (a) contains ammonium ions and nitrite ions (b) is self-reacting at the temperature within the borehole and (c) reacts to form gaseous nitrogen and a relatively inert aqueous solution;

flowing the gas-generating solution into the top of the second pipe string while flowing fluid out of the top of the first pipe string and correlating the rates of flow to cause at least a significant proportion of the liquid within the first pipe string in a location above the bottom of the second pipe string to be replaced by gas; and continuing said inflowing and outflowing of fluid while adjusting said rates of flowing fluid, to the extent required, to cause the pressure within the borehole at said fluid-removal depth to be reduced to and maintained at a selected relatively low value for a selected time while liquid inclusive of whatever liquid is drawn in from the reservoir is being gas-lifted to a surface location.

2. The process of claim 1 in which said gas-lifting of liquid is continued for at least a plurality of hours.

3. The process of claims 1 or 2 in which said first pipe string is equipped with a downhole pressure-recording gauge means arranged to be located at a known relatively short distance above said fluid-removal location.

4. The process of claims 1 or 2 in which the correlation between the reaction rate of the gas-generating components and the rate of flowing the gas-generating solution into the well is such that by the time the inflowing fluid reaches the depth of the fluid communication between the conduits, it contains enough gas to reduce its density gradient to less than that of the liquid in the borehole.

5. The process of claim 1 in which undesirable solid or liquid components are dissolved or dispersed within the liquid contained within the borehole and said liquid is gas-lifted from within the borehole in order to remove such components.

6. A process for testing a subterranean oil reservoir which is in fluid communication with a drilling fluid-containing borehole comprising:

extending a first pipe string which is equipped with a remotely-actuatable annulus packing means within the borehole so that the pipe string extends between the reservoir and a surface location;

actuating the packing means to seal the annulus around the first pipe string in a location above the reservoir;

extending a second pipe string within the first to a depth sufficient to provide a selected reduction in the fluid pressure within the borehole at the depth of the reservoir when a significant proportion of the liquid within the first and second pipe strings in locations above the bottom of the second pipe string is replaced by gas;

compounding a gas-generating aqueous liquid solution of inorganic compounds which solution (a) contains ammonium ions and nitrite ions (b) is self-reacting at the temperature within the borehole and (c) reacts for form gaseous nitrogen and a relatively inert, low-density and oil-immiscible aqueous solution;

flowing the gas-generating solution into the top of the second pipe string while flowing fluid out of the top of the first pipe string and correlating the rates of fluid inflor and outflow so that a significant portion of the liquid within those pipe strings in locations above the bottom of the second pipe string is displaced by gas; and continuing said inflowing and outflowing of fluid while increasing the relative rate of said fluid outflow to the extent required to cause the fluid pressure within the borehole at the reservoir depth to be reduced to and maintained at a selected relatively low value for a selected time while liquid inclusive of whatever liquid is drawn in from the reservoir is being gas-lifted to a surface location.

7. The process of claim 6 in which the gas-lifting of liquid while maintaining a relatively low fluid pressure within the borehole at the reservoir depth is continued for at least a plurality of hours.

8. The process of claims 6 or 7 in which said first pipe string is equipped with a downhole pressure-recording gauge means arranged to be located at a known relatively short distance above the reservoir.

9. The process of claim 6 or 7 in which the rates at which the gas-generating solution is flowed into the second pipe string while fluid is flowed out of the first pipe string are (a) initially arranged so that the fluid pressure within the borehole at the depth of the reservoir is kept substantially constant while liquid in those pipe strings above the bottom of the second pipe string is replaced by gas and (b) subsequently arranged to reduce the pressure within the borehole at the reservoir depth.

10. The process of claims 6 or 7 in which said gas-generating solution consists essentially of water, ammonium chloride and sodium nitrite.

11. A well treating process for gas-lifting liquid from a liquid-containing borehole comprising:

providing a first conduit extending within the borehole from a surface location to a selected fluid-removal depth within the liquid in the borehole;

providing a second conduit extending within the borehole from a surface location to a point of fluid communication with the first conduit and the liquid in the borehole at a depth low enough to cause a significant reduction in hydrostatic pressure at the fluid-removal depth when a significant proportion of the liquid in the first and second conduits above the point of fluid communication is replaced by gas;

compounding a gas-generating aqueous liquid solution of inorganic compounds which solution (a) contains ammonium ions and nitrite ions and (b) is self-reacting at the temperature within the borehole and (c) reacts to form gaseous nitrogen and a relatively inert aqueous liquid;

flowing the gas-generating solution into an upper portion of one of the conduits while flowing fluid out of an upper portion of the other conduit and correlating those rates of flow with the rate of gas-generation to cause at least a significant proportion of the liquid in at least one of the conduits to be replaced by gas; and continuing said inflowing and outflowing of fluid while further adjusting said rates of flow to the extent required to cause the hydrostatic pressure within the borehole at the fluid-removal depth to be reduced to and maintained at a selected relatively low value due to a gas-lifting of liquid inclusive of whatever liquid is drawn in from the reservoir from the borehole.

12. The process of claim 1 in which the gas-generating solution is flowed into an internal pipe string while fluid is being flowed out of the annulus between that pipe string and a surrounding conduit.

* * * * *